US007835230B1

(12) United States Patent
Chang

(10) Patent No.: US 7,835,230 B1
(45) Date of Patent: Nov. 16, 2010

(54) INFANT FEEDING MANAGEMENT SYSTEM

(76) Inventor: Stephanie Chang, 315 W. 70th St., Apt. 15K, New York, NY (US) 10023

( * ) Notice: Subject to any disclaimer, the term of this patent is extended or adjusted under 35 U.S.C. 154(b) by 0 days.

(21) Appl. No.: 12/435,943

(22) Filed: May 5, 2009

(51) Int. Cl.
*G04F 10/00* (2006.01)

(52) U.S. Cl. ..... 368/109

(58) Field of Classification Search ..... 368/107–109, 368/120
See application file for complete search history.

(56) References Cited

U.S. PATENT DOCUMENTS

| | | | | |
|---|---|---|---|---|
| 4,493,043 | A | 1/1985 | Forbath | |
| 4,972,391 | A | 11/1990 | Juve et al. | |
| 5,365,496 | A * | 11/1994 | Tolan-Samilow | 368/109 |
| 5,691,932 | A * | 11/1997 | Reiner et al. | 368/10 |
| 6,335,907 | B1 * | 1/2002 | Momich et al. | 368/10 |
| 6,886,139 | B2 * | 4/2005 | Liu | 715/864 |
| 2006/0179542 | A1 | 8/2006 | Pierce | |
| 2007/0008826 | A1 | 1/2007 | Hung | |
| 2009/0109798 | A1 * | 4/2009 | West et al. | 368/10 |

OTHER PUBLICATIONS

*Baby Tracker: Nursing,* iPhone Application, by Andesigned, Version Release Summary, screenshot capture Apr. 22, 2010 (original publication date unknown), Version 1.0 release date: Aug. 12, 2008 (subsequent version release dates unknown); see http://www.andesigned.net/nursing.htm (2 Pages).

*Baby Tracker: Nursing,* iPhone Application, by Andesigned, Feature Summary and Instructions, screenshot capture Apr. 22, 2010 (original publication date unknown); see http://www.andesigned.net/nursing.htm (4 Pages).

* cited by examiner

*Primary Examiner*—Vit W Miska
*Assistant Examiner*—Sean Kayes
(74) *Attorney, Agent, or Firm*—Leason Ellis LLP

(57) ABSTRACT

An infant feeding management system automatically advances a next feeding alert time to a time that is equal to a feeding time interval plus a time elapsed between the previous feeding alert time and the time at which feeding actually begun. In this way, the interval between successive feeding alert times is varied to reflect actual feeding of the infant and thereby maintain a constant interval between actual infant feeding start times and feeding alert times.

8 Claims, 5 Drawing Sheets

310

| Alarm-Shift Register | | | |
|---|---|---|---|
| Interval | Delay | Start | Next Alarm |
| 3:00 (I) | 30 min ($D_2$) | 3:42 pm ($S_3$) | 6:42 pm ($A_3$) |
| 3:00 (I) | 12 min ($D_1$) | 12:12 pm ($S_2$) | 3:12 pm ($A_2$) |
| 3:00 (I) | 0 min ($D_0$) | 9:00 am ($S_1$, $A_0$) | 12:00 pm ($A_1$) |

INFANT FEEDING MANAGEMENT SYSTEM

TECHNICAL FIELD

The present invention relates to systems and devices for the management of feeding of infants and young children.

BACKGROUND

Doctors often recommend feeding infants and very young children at a regular interval. Doctors also recommend that a feeding schedule be maintained around the clock. The doctor may adjust the recommended feeding interval based on a variety of factors such as the age, weight, and/or health of the child. Doctors recommend three hours as a typical feeding interval for infants and young babies.

Maintaining this feeding schedule can be a daunting task, especially for new parents. It can be very difficult to maintain a feeding schedule that requires feeding a child every three hours around the clock for weeks on end. Feedings are required several times throughout the night, which requires a caregiver to wakeup periodically to feed the child. It may also be hard to maintain the schedule while carrying out various other tasks throughout the day. Sometimes parents may just find it difficult to keep track of when the exact time the last feeding occurred. This problem is further compounded when the child is cared for by multiple persons at different times, for example, where one parent cares for the child for one part of the day and the other parent is responsible for caring for the child another part of the day, or even where there is a third-party caregiver such as an extended family member or a nanny. Keeping track of the feeding of the child and maintaining a regular feeding schedule at a set interval can prove difficult.

SUMMARY

In one aspect, the present invention is directed to a system for managing a feeding of an infant. The system includes a clock circuit that keeps time, a memory, interface, and a processor or module. The interface is used to set a feeding time interval and the memory stores the feeding time interval. The module is operatively connected to the interface and the memory and is configured to calculate a first feeding alert time as being equal to the begin time plus the feeding time interval. The system further includes alarm-setting means for automatically advancing a next feeding alert time to a time after the first feeding alert time that is equal to the feeding time interval plus a time elapsed by the clock circuit between the first feeding alert time and a next begin time obtained through the interface, such that the alarm-setting means varies the interval between successive feeding alert times to reflect actual feeding of the infant and thereby maintains a constant interval between actual infant feeding begin times and feeding alert times. The system includes alert means for producing a feeding alert in response to the first feeding alert time and the next feeding alert time being reached by the clock circuit.

In accordance with further, optional aspects of the invention, the system can include additional features and various combinations thereof. The system can store in the memory whether a left breast, a right breast, or a bottle is used, and using a toggle module, indicate a preferred breast to be used at the next feeding time based on the last breast used. The system can also store whether a left breast, a right breast, or a bottle is used and the start and stop times of use. Using the stored information, a balance module indicates a next preferred breast based on the start and stop times associated with each breast. Further, the system can use stored historical start and stop times for the breasts used and indicate a preferred breast at the next feeding. The system can include a display for displaying a current time, the feeding time interval, the first feeding alert time, and/or the next feeding alert time. The alert that indicates it is the next time to feed can be and audible tone, a vibration, a visible indication, a music recording, and/or a voice recording. Communication means can be included for sending stored data to a remote storage device. The module of the system can also be configured to trigger a backup alarm in the event that, in the absence of a feeding start-time being input, a prescribed period of time elapses after the feeding time alarm has triggered.

BRIEF DESCRIPTION OF THE DRAWING FIGURES

DETAILED DESCRIPTION OF CERTAIN EMBODIMENTS

By way of overview and introduction, when feeding an infant it is important to maintain a regular feeding schedule. However, the actual feeding habits of infants make maintaining a regular schedule difficult. The infant may be fussy and not want to feed at the exact time the option to feed is presented to the child. This unpredictable delay in feeding will make setting reminder alarms at set intervals ineffective at maintaining a regular feeding time interval. The present invention addresses this issue and others.

Figure 1:
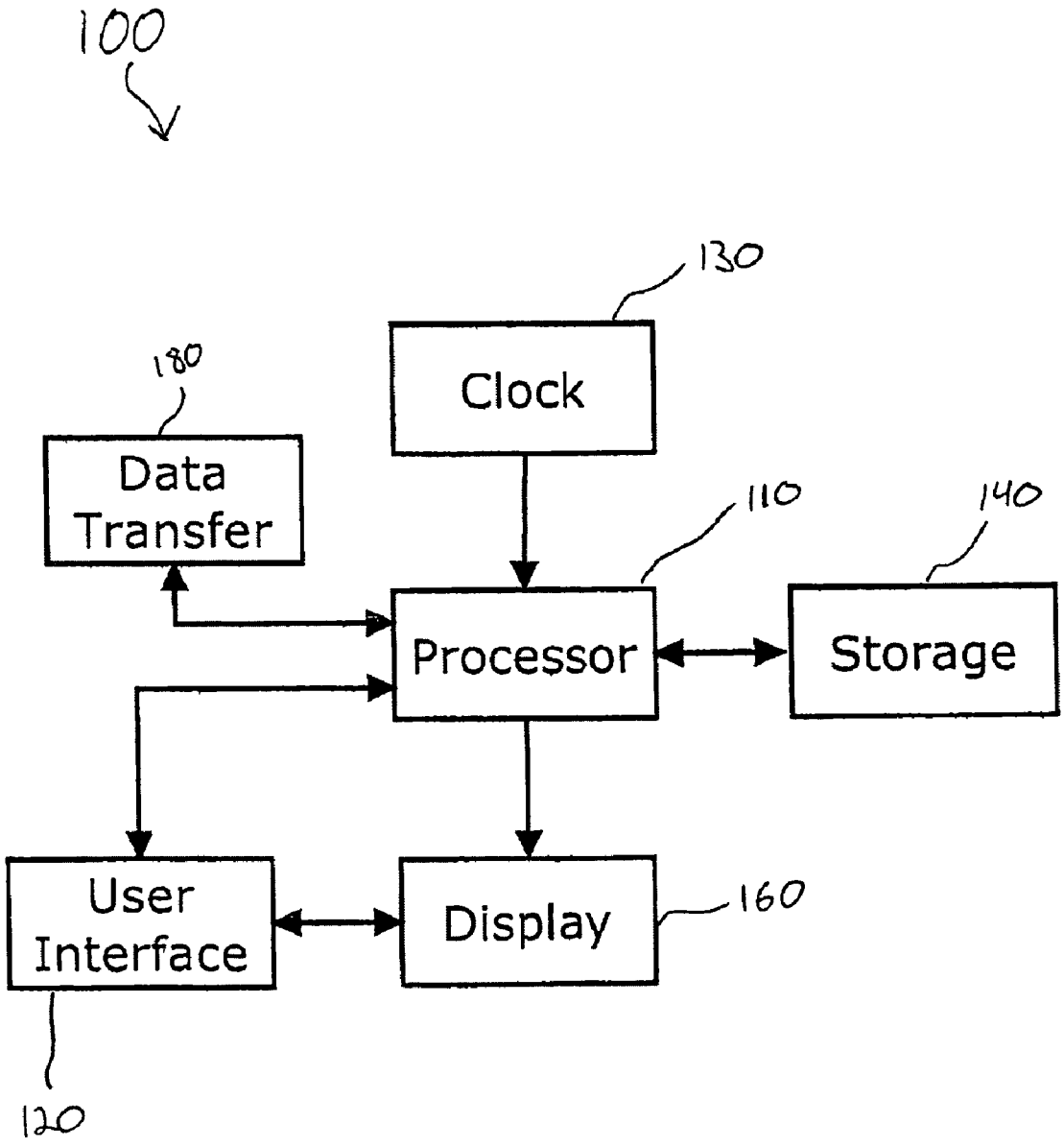
FIG. 1 is a schematic of a system configured to implement the methods of the present invention.

Referring now to FIG. 1, there is shown an infant feeding management system 100 for determining feeding times for an infant and providing indication to a user when to feed an infant in order to manage a feeding schedule according to one illustrative embodiment of the present invention. In the illustrated embodiment, the infant feeding management system 100 includes a hardware module for running software and performing calculations, such as a processor 110. The processor 110 is electrically connected to a user interface unit 120 and is configured to process signals received from the user interface 120 relating to actual feeding parameters inputted by a user. The processor 110 is connected to a clock circuit 130 that keeps time. The clock device 130 can be a clock circuit that counts time, and can be in the form of a counter circuit or a module that keeps track of actual time. Information, such as feeding history data and feeding method data, for example, is stored and recalled from a storage device 140 such as a memory that is connected to the processor 110. The processor 110 communicates with the storage device 140 which configures the processor 110 to implement the processes of the present invention. The processor 110 is connected to a display 160 for displaying information to the user. The processor 110 is also connected to a data transfer module 180 for communicating information between a remote device, such as a home computer or physician's computer, for example. The data transfer module 180 provides a communication link, which can comprise a wired connection such as USB, Ethernet cable, etc. or a wireless connection via a local area network, Bluetooth® communication protocol, or a cellular communication network, etc.

Figure 2:
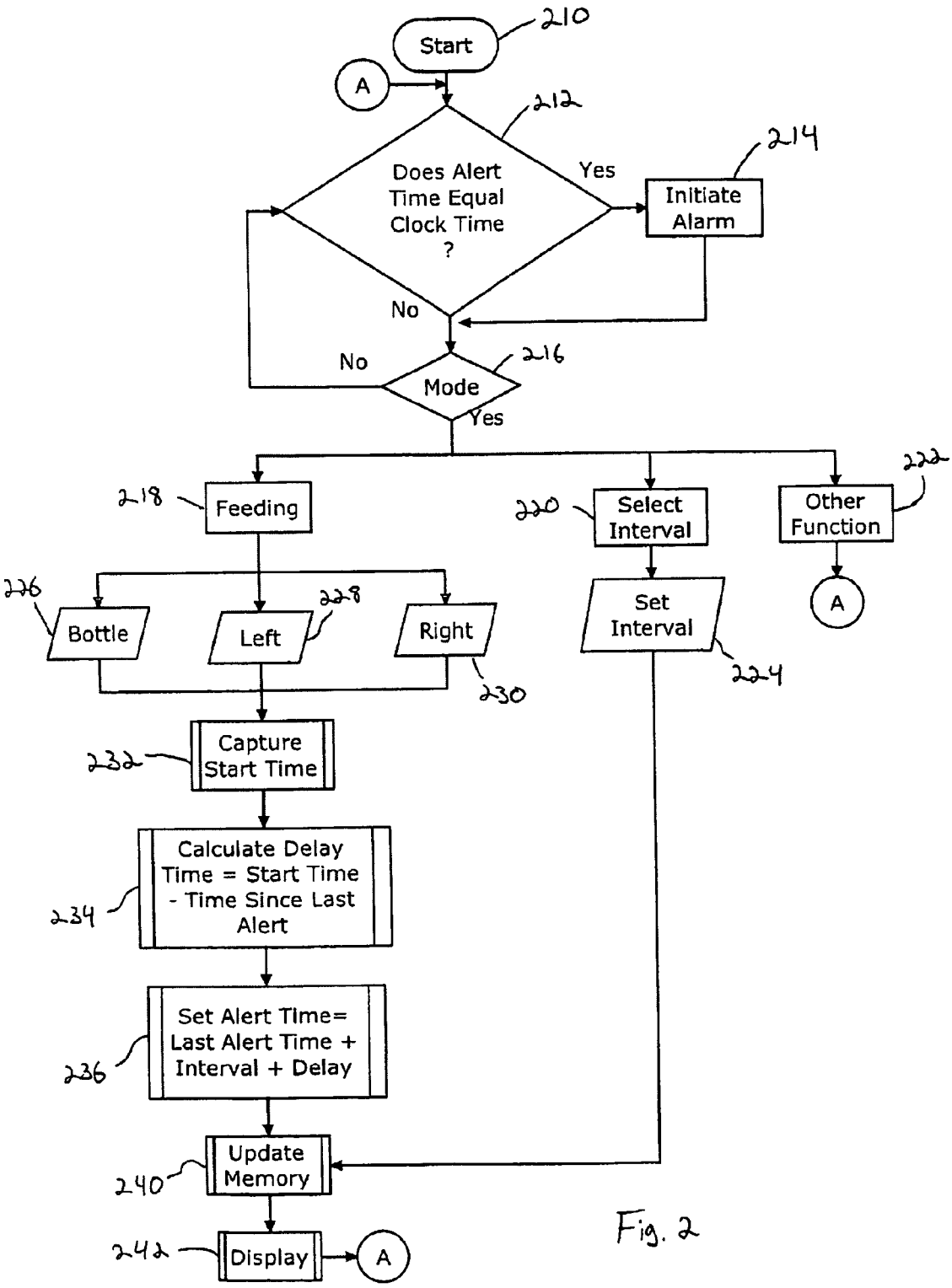
FIG. 2 is a flow diagram of a method in accordance with an aspect of the invention that determines feeding alert times.

Referring now to FIG. 2, the operation of the processor device 110 in determining whether an alert time has been reached at which time the user is to be alerted that it is time to feed the infant again is described in conjunction with the above structural description of the infant feeding management system 100.

At step 210, the system is started. As a first matter, at step 212 the system determines whether or not an alert time is set and determines whether the alert time equals the current clock time. The processor compares the clock time maintained by the clock module 130 to a stored alert time in storage device 140. If the alert time equals the current clock time, then an alarm is initiated at step 214 to produce a feeding alert to indicate that is time to feed the infant. The alarm can be in the form of a visual, auditory, and/or physical alert. A visual alert can be in the form of a light, a message can appear on the display, or the display can blink on and off to alert the user, for example. The alert can also be in the form of an alarm sound, such as ringing or beeping, a song, such as a favorite song or nursery rhyme, a voice recording, such as playing a recorded message from the mother, or a calm white noise sound, such as ocean waves or sounds imitating the womb. The alarm can also be in the form of a vibration.

If the alert time does not equal the clock time, or if there is currently no stored alert time, the system prompts a user to select a mode at step 216. By using the user interface 120, the user can select between a feeding mode 218, a select interval mode 220, or between other function modes 222 that are not specifically illustrated in FIG. 2, but may include a data transfer mode utilizing the data transfer device 180, for example.

The select interval mode 220 allows a user to select a time interval between feedings. The feeding time interval is one time value used by the system 100 to determine when to set the feeding alert time. In one embodiment, the system 100 includes a stored preset feeding time interval that is preset (e.g. factory preset) and stored in the storage device 140. While in select interval mode 220, the user can use the user interface 120 to modify the preset interval or, if there is no preset interval, select a new feeding time interval. The feeding time interval is set at step 224. One preferred exemplary interval is three hours. After the interval is set, the memory 140 is updated at step 240.

Once in feeding mode, the user next uses the interface 120 to indicate to the processor 110 the feeding method that is being used. The feeding method options include a bottle 226, left breast 228, or right breast 230. Once the user selects between the bottle 226, left breast 228, and right breast 230, this not only indicates to the processor 110 what method is being used but also that feeding of the child has begun. Thus, at step 232 the system captures the start time, which is the time at which feeding has started. The processor 110 receives a time signal from the clock device 130 when the interface 120 is utilized to indicate that feeding has begun and that time data is stored in the storage device 140.

In accordance with a salient aspect of the present invention, at step 234 the processor 110 calculates a delay time value. The delay time is equal to the difference between start time captured at step 232 and the previous alert time. Calculating the delay time is important to providing an accurate feeding schedule for the infant. Often there will be a delay between the time when feeding is supposed to begin and when the infant actually begins feeding. For example, in operation, when the processor 110 initiates an alarm at step 214 indicating that it is time to feed the child, it is often the case that some time will elapse between the initiating of the alarm and actually beginning to feed the child. This delay can be attributed to a number of factors. For instance, the caregiver may be occupied performing other tasks and is unable to immediately attend to the child or the child may take a significant amount of time to begin feeding once a feeding opportunity is presented. The time between the alarm and the actual begin feeding time of the infant can be significant. Therefore, calculating the delay time, which is utilized in determining an alert time as discussed below, is important to maintaining an accurate feeding schedule.

The delay time is calculated as the difference between the current start time and the last alert time. If, for example, the last alert time was 12:00 pm and the captured actual start time was 12:12 pm, the delay time would equal 12 minutes. Thus, the delay time is calculated at step 234 as the difference between the start time and the last alert time. In the special case where there is no last alert time (e.g., when the system is first used or reinitialized), the last alert time is set to the start time. Thus, the delay time will be calculated as zero.

Once the delay time is determined at step 234, the next feeding alert time is determined at step 236. The next feeding alert time is equal to the last alert time plus the delay time plus the feeding time interval. By taking into account the last alert time, the feeding time interval, and the delay time, the system provides an automatically sliding alarm that is adjusted to take into account the feeding time interval and any delay between the last alarm and the actual start time of the infant feeding. If, for example, the last alert time is 12:00 pm, the feeding time interval is three hours, and delay time is twelve minutes, the next alert time would be set to 3:12 pm in accordance with the invention. Thus, the alert time is calculated and applied in an automatically sliding or shifting manner because the alert time calculation at step 236 takes into account the delay time in addition to the last alert time and the prescribed feeding interval. Accordingly, the system automatically advances the next feeding alert time to a time after the previous alert time that is equal to the feeding time interval plus a time elapsed between the previous feeding alert time and the time at which the next feeding starts. In the special case where there is no previous alert time (e.g., when the system is first used or reinitialized), the previous alert time is set to the start time. Thus, the next alert time is calculated as the start time plus the feeding time interval (the delay time equals zero in this case as discussed above).

The function of the automatically sliding alert time is now described in more detail with reference to FIG. 3. Notably, the time at which feeding is stopped is not taken into account in any of the determinations in the embodiment of the invention illustrated in FIG. 2. The next alert time is determined based on the delay, the interval, and the last alert time. The stop time (that is, the time at which a particular feeding session ends) is not required for setting the next alarm.

The memory 140 is updated with the delay time, the captured start-time, and the next alert-time at step 240. The display is updated at step 242 to display various information such as the next alert time, the start time, the delay time, and other information concerning management of the feeding schedule.

Figures 3A, 3B:
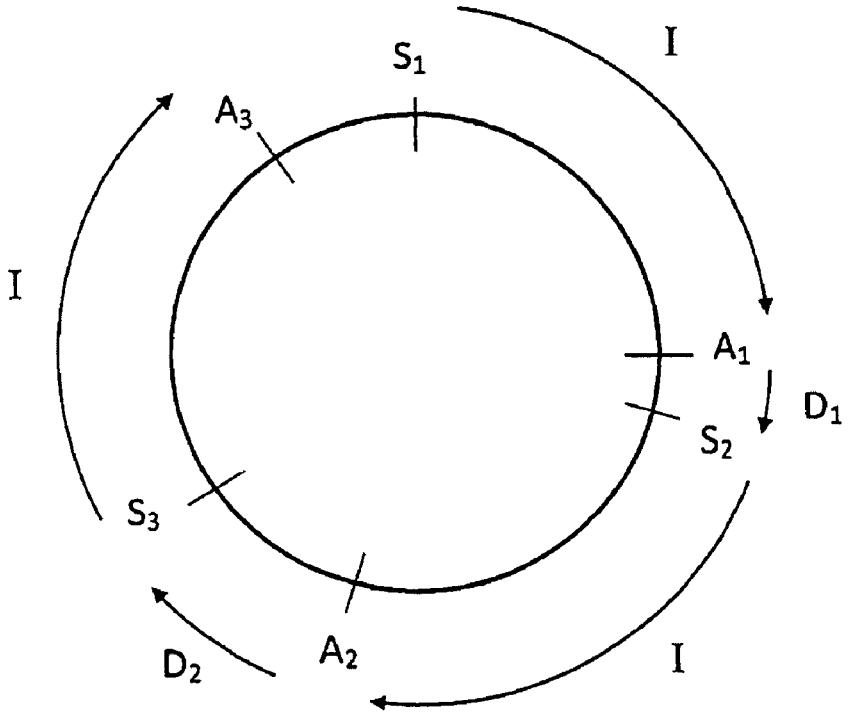
FIG. 3A is a representation of a sliding alert function.
FIG. 3B is a representation of data stored in an alarm register.

FIGS. 3A and 3B illustrate the automatic sliding alert function of the infant feeding management system 100. FIGS. 3A and 3B represent three consecutive iterations of the execution of process 200 in connection with the management of the feeding schedule of an infant. The start time, delay times, alert times, and interval shown in FIG. 3A correspond to the values shown in an alarm-shift register 310 in FIG. 3B. The values shown in alarm-shift register 310 correspond to data stored in storage device 140.

Once an initial feeding has begun, the start time $S_1$ is captured. As can be seen in FIG. 3B, the initial start time $S_1$ is 9:00 am in this illustrative example. The delay time $D_0$ is calculated as the start time $S_1$ minus the last alert time $A_0$. Since this is the special case of the first feeding, the last alert time $A_0$ is set to the start time $S_1$. Thus, the delay time $D_0$ is calculated as being zero minutes ($D_0=S_1-S_1$; 9:00 am−9:00 am=0 min). The first alert time $A_1$ is equal to the last alert time $A_0$ plus the interval I plus the delay time $D_0$. Again, since this is the special case of the first feeding, the last alert time $A_0$ is set to the start time $S_1$. Thus, the next alert time $A_1$ is equal to $S_1+D_0+I$ or 9:00 am+0 min+3 hr, which equals 12:00 pm. Accordingly, as can be seen in the alarm-shift register 310, alert time $A_1$ is set to 12:00 pm.

In use, if the processor compares the clock time to the alert time $A_1$ and determines that they are equal, an alarm is initiated. The alarm signals to the user that it is again time to feed the infant. As can be seen in FIG. 3A, there is a delay time $D_1$ between the alert time $A_1$ and when the infant actually began to feed $S_2$. In this case, the start time $S_2$ was at 12:12 pm and the alert time $A_1$ was 12:00 pm (FIG. 3B). Accordingly, the delay time $D_1$ is equal to twelve minutes ($D_1=S_2-A_1$; 12:12−12:00=12 min). The next alert time $A_2$ is equal to the last alert time $A_1$ plus the delay time $D_1$ and the interval I. In this case, as can be seen in the alarm-shift register 310, the next alert time is now set to 3:12 pm ($A_2$=12:00 pm+12 min+3 hr=3:12 pm). As such, the interval between feedings is maintained at the preset interval (3 hours) from the start of actual feeding free of (that is, without) the user having to make any adjustments to the alarm start-time.

Again, once the alarm is initiated, there is delay between when the alert time $A_2$ and when the infant actually begins to feed $S_3$. The delay time $D_2$ is equal to thirty minutes. The next alert time $A_3$ is equal to the last alert time $A_2$ plus the delay time $D_2$ plus the interval I. As can be seen from register 310, the next alert time $A_3$ is equal to 6:42 pm in this case. Again, the interval between alarms is maintained at the preset interval.

Accordingly, it can be seen that the time between successive alerts $A_1$, $A_2$, and $A_3$ is not a set interval. The time between $A_1$ and $A_2$ is not equal to the time between $A_2$ and $A_3$. This is unlike a typical alarm clock where a time is set and alarm is initiated at that same time everyday or an interval is set and the alarm is initiated at the set interval. Rather, the alert times are automatically shifted to take into account the actual feeding of the infant. There is no set time between successive alarms. If the infant is particularly fussy during one feeding attempt and it takes a long time to get the infant to feed, the infant feeding management system 100 takes that into account and automatically shifts the next feeding alert time. Thus, time between the feedings of the infant can be more accurately maintained and the feeding schedule of the infant can be more accurately regulated.

An offset time value can also be stored and included in the calculation of the alert time. The alert time would be calculated as described above but further include the subtraction of an offset time value. By subtracting the offset time value in the calculation of the alert time, the alert time will be set to a time that is earlier by a value equal to that of the offset time interval. Thus, the alarm will be triggered earlier. For example, the offset time value can be set to be equal to five minutes. Thus, when the alert time is calculated it will be set to a time that is five minutes earlier than it would have been without the offset. In this way, the system automatically provides a grace period for the user to get settled and begin to start feeding. This increases the likelihood that the time at which feeding actually begins will be closer to the ideal feeding time. A separate early warning alarm can also be included. When the system starts, it will first check if the alert time equals the current clock time plus an offset time value. When this occurs an early warning alarm is triggered. For example, if the alert time is equal to 12:00, the current clock time is 11:55, and the offset time is five minutes, the early warning alarm will be triggered. The early warning alarm can be different from the feeding alarm. The early warning alarm can be a single chime or buzz which is to indicate that it is almost time to feed. Then, when the current clock time is equal to the feeding alert time, the alarm to indicate that is time to feed is initiated as discussed above.

Figure 4:
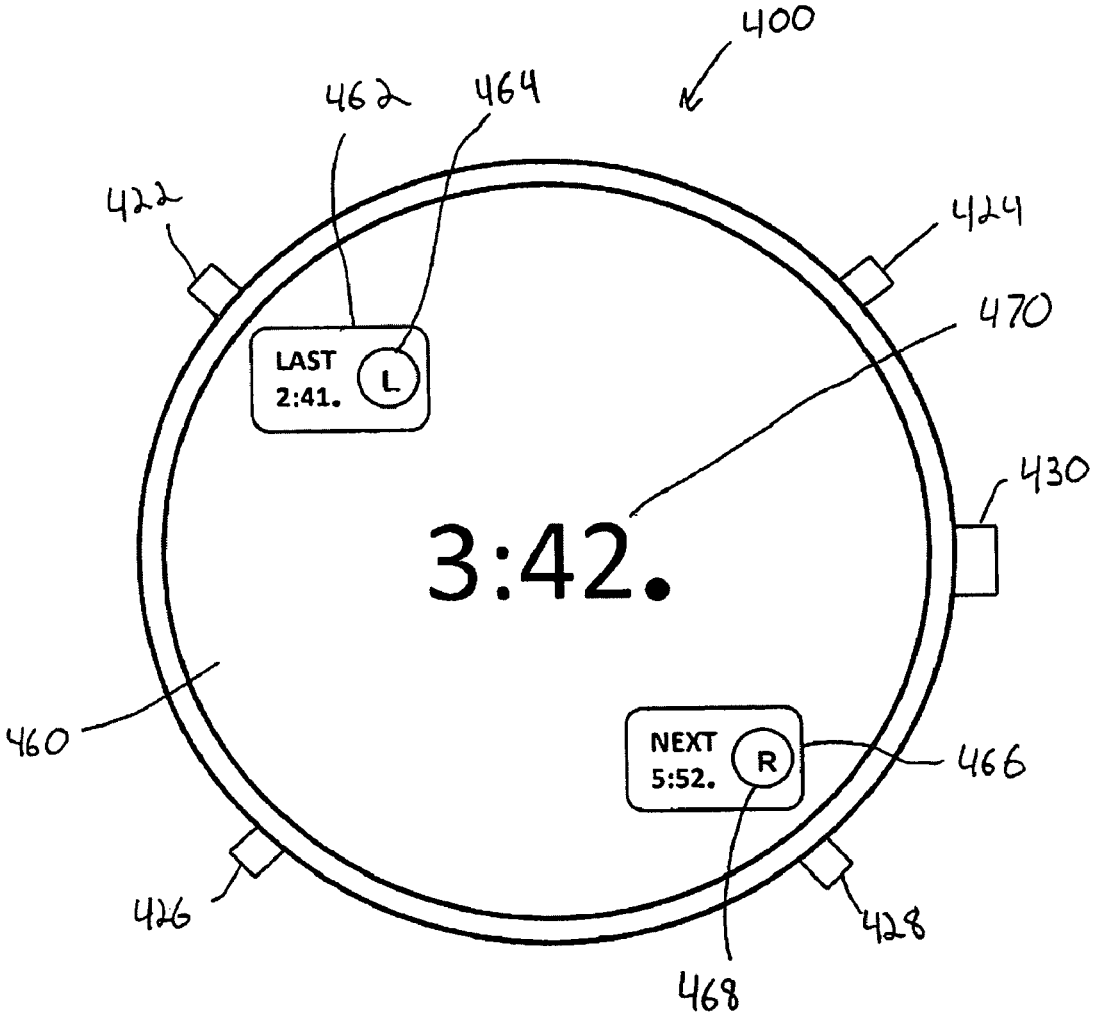
FIG. 4 is a schematic illustration of an electronic device that can be used to implement the invention.

Referring now to FIG. 4, the infant feeding management system 100 is shown in one embodiment in the form of a watch-type device 400. The watch-type device 400 can include straps or a band for wearing on a wrist, or a clip for securing to a pocket, belt loop, etc. Buttons 422, 424, 426, 428, and 430 form a part of the user interface 120. Pressing single buttons or buttons in combination allows a user to navigate through the different modes of operation or menus of the system 100. In the illustrated embodiment of FIG. 4, pressing button 422 indicates that feeding of the infant has begun with the left breast, pressing button 424 indicates feeding with the right breast, pressing button 426 indicates bottle feeding, and pressing button 428 indicates pumping. Button 430 is a menu button that allows the user to navigate the different functions of the device. The display 460 includes various icons or symbols, such as L, R, and B to represent a left breast, right breast, and bottle, respectively, for example. The display 460 functions as a part of the interface for visually reporting information about feeding times and preferred next breasts to be used. The display 460 also indicates when the last feeding started and the next feeding alert time. To the extent that the system keeps track of which was the last breast used to feed and determines a next preferred breast to be used, for example as described below in connection with FIG. 5, the display 460 indicates when the last feeding started and which breast was used and the next feeding alert time and which is the next preferred breast to be used. In the illustrated embodiment, the display 460 includes a display area 462 for display the last feeding time and an area 464 for displaying the last breast used. The display 460 also includes another display area 466 for displaying the next feeding alert time and an area 468 for displaying the next preferred breast. The current time is displayed in a central area 470 of the display 460. The watch-type device 400, buttons 422-430, and display 460 is only one illustrative embodiment of a device in which the infant feeding management system 100 can be implemented. The system can be implemented in a number of different forms and can include various interfaces, such as buttons, switches, or dials, etc., and the display can be configured to display a varied array of information and parameters and include a variety of icons and symbols.

Further, the infant feeding management system need not be implemented on a watch-type device, but it also can be implemented on a variety of electronic devices. In one embodiment the system is implemented as a software application running on a separate electronic hardware device such as a cellular telephone, personal digital assistant, portable computer, portable gaming device, or any other electronic device. For example, the process 200 outlined in FIG. 2 can be implemented as a software application running on an Iphone® or Itouch® device made by Apple Computer, Inc. of Cupertino, Calif. In that case, the process 200 can be executed in a processor and using a system clock, storage, a display, and a user interface that are associated with the host device in the same manner as described above.

Figure 5:
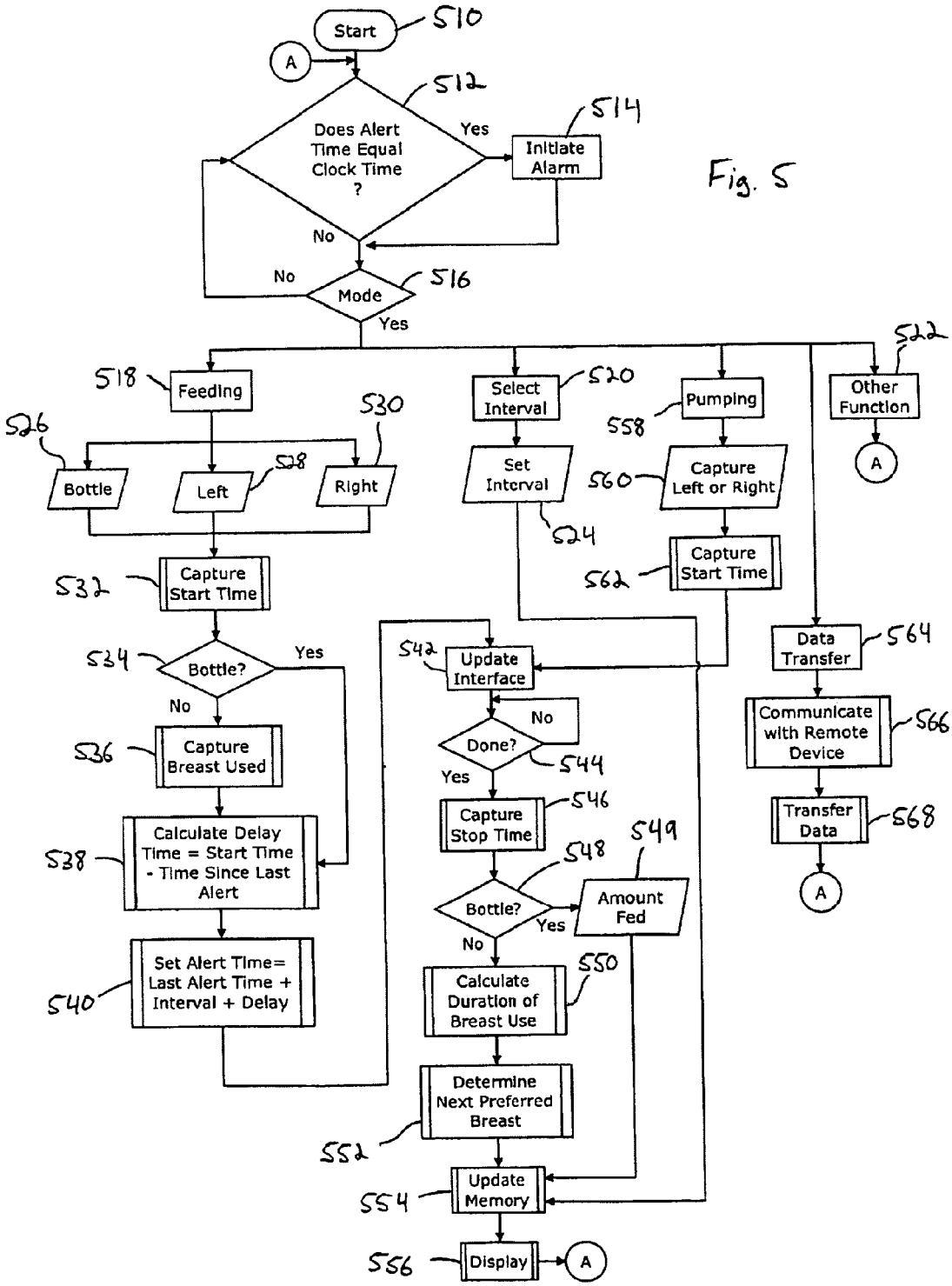
FIG. 5 is a flow diagram of a method in accordance with another aspect of the invention.

Referring now to FIG. 5, the operation of the processor device 110 in determining alert times and additional functions according to further embodiments of the invention is described in conjunction with the structural description of the infant feeding management system 100 as shown in FIG. 1. The embodiment illustrated in FIG. 5 may be an alternative embodiment or an embodiment that includes additional features over the embodiment of FIG. 2.

At step 510, the system is started. At step 512 the system determines whether or not an alert time is set and determines whether the alert time equals a clock time. The processor compares the clock time maintained be the clock module 130 to a stored alert time in storage device 140. If the alert time equals the clock time, then an alarm is initiated at step 514. If the alert time does not equal the clock time, or if there is currently no stored alert time, the system prompts a user to select a mode at step 516. By using the user interface 120, the user can select between a feeding mode 518, a select interval mode 520, a pumping mode 558, a data transfer mode 564, or between other function modes 522 that are not specifically illustrated in FIG. 5.

The select interval mode 520 allows a user to select a time interval between feedings. The feeding time interval is set at step 524. After the interval is set, the memory 140 is updated at step 554.

In feeding mode 518, the user uses the interface 120 to indicate to the processor 110 the feeding method that is being used. The feeding method options include a bottle 526, left breast 528, or right breast 530. Once the user selects between the bottle 526, left breast 528, and right breast 530, this not only indicates to the processor 110 what method is being used but also that feeding of the child has begun. Thus, at step 532 the system captures the start time, which is time at which feeding has started. The processor 110 receives the time signal from the clock device 130 and the data is stored in the storage device 140.

At step 534, the processor 110 confirms whether the user indicated a bottle 530 was being used. If a bottle was used, the system skips to step 538. If a bottle was not used, i.e., the right or left breast was used, the system proceeds to step 536. At step 536 the processor 110 captures the signal from the interface 120 indicating whether the right or left breast is being used and that data is stored in the storage device 140.

At step 538 the processor 110 calculates a delay time value. The delay time is equal to the difference between start time captured at step 532 and the previous alert time. In the special case where there is no last alert time (e.g., when the system is first used or reinitialized), the last alert time is set to the start time. Thus, the delay time will be calculated as zero.

Once the delay time is determined at step 538, the next feeding alert time is determined at step 540. The next feeding alert time is equal to the last alert time plus the delay time plus the feeding time interval. By taking into account the last alert time, the feeding time interval, and the delay time, the system provides an automatically sliding alarm that automatically adjusts to take into account the feeding time interval and any delay between the last alarm and the actual start time of the infant feeding. Thus, the alert time is calculated and applied in an automatically sliding or shifting manner. Accordingly, the system automatically advances the next feeding alert time to a time after the previous alert time that is equal to the feeding time interval plus a time elapsed between the previous feeding alert time and the time at which the next feeding begins. In the special case where there is no previous alert time (e.g., when the system is first used or reinitialized), the previous alert time is set to the start time. Thus, the next alert time is calculated as the start time plus the feeding time interval (the delay time equals zero in this case as discussed above).

In the process of FIG. 5, the user interface is next updated at step 542 to prompt the user to indicate when feeding is finished. In this regard, the process of FIG. 5 differs from an embodiment that implements a process 200. The processor 110 iteratively checks at step 544 to determine whether the user has utilized the interface 120 to indicate that feeding has finished. When the processor 110 receives a signal from the interface 120, the stop time is captured at step 546 by the processor 110 which obtains the time from the clock module 130 and stores that data in storage device 140.

At step 548, the processor 110 again confirms whether the user indicated a bottle 530 was being used. If a bottle was used, the system prompts the user to input the amount that was consumed by the infant at step 549. The user can determine the amount fed to the infant by, for example, reading the gradations that are often included on the side of a bottle or by any other method, and enter that value using the interface 120 which is then stored in the storage device 140. Once the feeding amount is entered the system skips to step 554. If a breast was used, the system proceeds to step 536. At step 536 the processor 110 calculates how long the particular breast was used in this feeding. The processor 110 accesses data from the storage device 140 relating to the start time that was captured at step 532 and the stop time that was captured at 546 in order to calculate the duration.

The next preferred breast, i.e., the breast that should be used during the next feeding, is determined at step 552 and indicated to the user via the display when it is updated at step 556. The manner of determining the next preferred breast can be done in several different ways. The next preferred breast can be selected to be the opposite breast that was used during the last feeding. No information related to duration of use is needed to make this determination. The next preferred breast is always the opposite of the last breast used. In this way, the system simply toggles between breasts, indicating that one is preferred for one feeding and that the other is preferred for the next. A toggle module, which can be incorporated into the processor 110 or be a separate module, or can be a software routine running on the processor 110, can make the determination of which is the next preferred breast.

A second method for determining the next preferred breast takes into the account the duration of use of the breasts. For example, if the right was used for thirty minutes during one feeding and the left was only used for five minutes during the next feeding, the next preferred breast would be the left again because of the relatively short duration of use of the left breast during the previous feeding. Information concerning only the last two breast feedings could be used or data compiled from the last ten breast feedings could be used, for example. The next preferred breast is recommended in a manner to maintain a balance of usage between the breasts. Maintaining usage balance between the breasts helps to prevent one breast from becoming painfully engorged, and helps to maintain a balance of production. A balance module, which can be incorporated into the processor 110 or be a separate module, or can be a software routine running on the processor 110, can make the determination of which is the next preferred breast.

The next breast could also be determined based on a history of usage of the breasts to feed the infant or baby. It is sometimes the case that one breast will typically produce less than the other. Accordingly, one breast may only on average be capable of feeding the child for a shorter duration of time. If, for example, the left breast was only typically good for ten minutes and the right breast is typically good for twenty minutes of production per feeding, this would affect which breast would be the next preferred breast. The system will recommend the next breast by comparing the previous feeding times with the historical production averages. If the last feeding time is close to the average feeding time for that breast, then the system recommends other breast for the next feeding. If, however, the last feeding time is less then the average feeding time, then system recommends the same breast as the next preferred breast in order to maintain balance.

Another method for determining the next preferred breast takes into account the aggregate feeding times of a predefined number of last feedings. For example, the system could total the last ten feeding times for each breast. If there is an imbalance in the total feeding times between the breasts, the system can designate the breast that has been used less as a preferred breast more often in order to maintain a balance of use between the breasts.

After the next preferred breast is determined at step 552, the memory is updated at step 554. The processor 110 then updates the display at step 556 with the relevant information related to the last feeding, the next feeding, the next preferred breast, and other information related to the feeding of the child.

The system also permits the collection of data related to breast pumping. Often mothers will use a breast pump to expel excess milk production to relieve painful engorgement of the breasts, or to collect and store milk for feeding via a bottle. However, the pumping of the breasts does not affect the feeding schedule of the infant since pumping is not a feeding activity. Therefore, the pumping of the breasts does not affect the alert time calculations or the setting of feeding alarms.

The user can select the pumping mode at step 558. The user uses the user interface 120 to indicate which breast is being used at step 560. The processor 110 captures this breast usage information and stores it in storage 140. The indication of breast usage also indicates that pumping has begun. Accordingly, at step 562, the start time is captured. Then the system proceeds to steps 542-556 in which the stop time is captured and the next preferred breast is determined as discussed above. In addition, the system can prompt the user to input using the interface 120 the amount of milk pumped, which is then stored by the storage device 140.

Optionally, the system can also provide a data transfer mechanism for exporting historical feeding schedule data. The user uses the interface to select the data transfer mode at step 564. Communication is the established with a remote device via the data transfer module 180 at step 566. At 568, the processor 110 retrieves data from the storage 140 and communicates the data with the data transfer module 180, which then in turn transfers the data to a remote device. The remote device can be a computer, PDA, cellular telephone or other electronic device that has a compliant communications module to communicate with the system 100.

The data transfer function is useful because information can be transmitted to a remote device for long term storage. It also allows data to be transferred to a doctor for review. Based on the information regarding the feeding times of the infant, the doctor can recommend changing the feeding time interval, for example. If the delay is consistently long, the doctor can recommend setting the feeding time interval to a shorter interval.

The system can also automatically take into account the average delay in feeding of the child and implement another offset to account for the delays. By averaging the stored delay time data for the previous feedings, such as the last ten feedings, an average delay time can be calculated. The average delay time can be used when setting the next alert time. For example, when calculating the next alert time, one half of the average delay time can be subtracted in the calculation in order to cause the next feeding alert time to be set to an earlier time. Thus, the user will begin to try to feed the infant earlier. For example, if the infant on average delays thirty minutes before feeding, the feeding alert time would be set fifteen minutes earlier than it would without taking into account the average delay. Accordingly, the user will begin to try and feed the infant earlier, but because the infant normally delays before feeding, the actual time the infant begins to feed will be closer to the desired feeding time interval. By setting the next alert time earlier to take into account an average delay time, the time that elapses between when the infant actually began to last feed and when the infant actually begins to next feed will, on average, be closer to the desired feeding time interval. This will provide for a more regular actual feeding interval for the infant.

An additional feature, a backup alarm function can be included. The backup alarm will be initiated if a prescribed period of time elapses after the feeding time alarm is triggered, yet there has been no indication that the infant has been feed. This will help prevent instances where the feeding alarm went off, but was either unnoticed or noticed but subsequently forgotten about (e.g. caregiver accidently fell back asleep before feeding child). A second alert time can be set for a predefined interval, e.g. thirty minutes, and after that interval has elapsed and there is no indication that the child has been feed, a backup alarm is triggered.

Having thus described preferred embodiments of the present invention, it is to be understood that the foregoing description is merely illustrative of the principles of the present invention and that other arrangements, methods, and systems may be devised by those skilled in the art without departing from the spirit and scope of the invention as claimed below.

What is claimed is:

1. A system for managing a feeding of an infant, comprising:

a clock circuit that keeps time;

a memory for storing a feeding time interval;

interface means for obtaining a start time;

a module operatively connected to the interface means and the memory and configured to calculate a first feeding alert time as being equal to the start time plus the feeding time interval;

alarm-setting means for automatically advancing a next feeding alert time to a time after the first feeding alert time that is equal to the feeding time interval plus a time elapsed by the clock circuit between the first feeding alert time and a next start time obtained through the interface, such that the alarm-setting means varies the interval between successive feeding alert times to reflect actual feeding of the infant and thereby maintains a constant interval between actual infant feeding start times and feeding alert times; and alert means for producing a feeding alert in response to at least one of the first feeding alert time and the next feeding alert time being reached by the clock circuit.

2. The system according to claim 1, wherein the interface means obtains the start time together with an indication of whether a left breast, a right breast, or a bottle is being used; wherein the memory stores the indication; and the system further comprises:

a toggle module operatively connected to the interface means and the memory and configured to report through the interface means a preferred breast based on the indication obtained just prior to the next start time at least at the time of the next feeding alert time.

3. The system according to claim 1, wherein the interface means obtains the start time together with an indication of whether a left breast, a right breast, or a bottle is being used, and a stop time; wherein the memory stores the indication together with the start time and the stop time; and the system further comprises:

a balance module operatively connected to the interface means and the memory and configured to report through the interface means a preferred breast based on the start and stop times associated with each breast at least at the time of the next feeding alert time.

4. The system according to claim 3, further comprising:

communication means for sending stored data to a remote storage device.

5. The system according to claim 1, wherein the interface means obtains the start time together with an indication of whether a left breast, a right breast, or a bottle is being used, and a stop time; wherein the memory stores the indication together with the start time and the stop time, wherein the module is further configured to calculate, a historical production data for each of the left and right breasts and to use the historical production data to report through the interface means a preferred breast at least at the time of the next feeding alert time.

6. The system according to claim 1, further comprising:

a display for displaying at least one of a current time, the feeding time interval, the first feeding alert time, and the next feeding alert time.

7. The system according to claim 1, wherein the feeding alert is at least one of an audible tone, a vibration, a visible indication, a music recording, and a voice recording.

8. The system according to claim 1, wherein the module is further configured to trigger a backup alarm in the event that, in the absence of a feeding start-time being input, a prescribed period of time elapses after the feeding time alarm has triggered.

* * * * *